United States Patent [19]

Schmidt et al.

[11] Patent Number: 4,996,900

[45] Date of Patent: Mar. 5, 1991

[54] END DOGGING SAWMILL CARRIAGE WITH INDEPENDENT DRIVES RELEASABLY CONNECTED TOGETHER

[75] Inventors: Hugh E. Schmidt, Portland; Arthur L. McGee, Lake Oswego, both of Oreg.

[73] Assignee: The Coe Manufacturing Company, Plainesville, Ohio

[21] Appl. No.: 464,892

[22] Filed: Jan. 16, 1990

[51] Int. Cl.[5] ..... B27B 29/08

[52] U.S. Cl. ..... 83/435.1; 83/707; 83/731; 144/245 A; 144/245 E; 198/468.2; 198/621; 198/748

[58] Field of Search ..... 83/707, 731, 435.1, 83/415, 710, 711, 466; 144/245 A, 245 E; 198/621, 748, 468.2

[56] References Cited

U.S. PATENT DOCUMENTS

| | | | |
|---|---|---|---|
| 3,503,428 | 3/1970 | Ackerfeldt | 143/25 |
| 3,779,117 | 12/1973 | Roberson et al. | 83/707 X |
| 4,317,398 | 3/1982 | Jones et al. | 83/156 |
| 4,338,986 | 7/1982 | Detjen | 144/39 |
| 4,422,487 | 12/1983 | McCurdy | 144/24 SE X |
| 4,697,487 | 10/1987 | Cameron | 83/708 |

FOREIGN PATENT DOCUMENTS 0195423 9/1986 European Pat. Off. .

*Primary Examiner*—Douglas D. Watts
*Assistant Examiner*—Kenneth E. Peterson
*Attorney, Agent, or Firm*—Klarquist, Sparkman, Campbell, Leigh & Whinston

[57] ABSTRACT

An end dogging sawmill carriage is described, including a pair of front and rear carriage units having dogs which engage the opposite ends of a log and a pair of independent drives for such carriage units. The pair of drives are temporarily connected together by a releasable connector means to maintain the log clamped between the carriage units as such pair of drives share the load and both drive the log through the primary breakdown log cutting apparatus. The releasable connector can by a cylinder actuated cable clamp mounted on the rear carriage unit for clamping the first drive cable of the front carriage unit in response to an electrical control signal applied to a solenoid valve for operating the clamp cylinder. In another embodiment the releasable connector is a solenoid actuated lock which operates a latch member to selectively engage one of a plurality of notches spaced along a notched connecting rod attached between the end of the first cable and the front carriage. A third embodiment of the releasable connector is a solenoid valve actuated brake for engagement with an unnotched connecting rod.

20 Claims, 4 Drawing Sheets

AIR SUPPLY
FLUID SUPPLY
M2
M1

END DOGGING SAWMILL CARRIAGE WITH INDEPENDENT DRIVES RELEASABLY CONNECTED TOGETHER

BACKGROUND OF INVENTION

The present invention relates generally to sawmill carriages and in particular to end dogging sawmill carriages, including front and rear carriage units having dogs which engage the opposite ends of a log and a pair of independent drive means for such carriage units which are releasably connected together temporarily to maintain the log clamped between the carriage units while such pair of drive means both share the load and drive the log toward a primary breakdown log cutting means.

A dual carriage system, including two of such end dogging carriages can be provided on opposite sides of the index line of the same primary breakdown log cutting means for more efficient operation and higher lumber production. As a result, one carriage can be loaded with the next log while a first log is being transmitted by the other carriage through the cutting means such as chipping heads and saws to cut the log into lumber.

It has been previously proposed to provide an overhead end dogging sawmill carriage with a pair of carriage units, including a front unit and a rear unit which are driven by a common drive means such as a motor-driven cable as shown in European Patent Application Publication No. 0 195,423 of Foster, published Sept. 24, 1986, assigned to Kockums Cancar, Inc.; U.S. Pat. No. 4,697,487 of Cameron, issued Oct. 6, 1987; and U.S. Pat. No. 4,317,398 of Jones, et al., issued Mar. 2, 1982. The front and rear carriage units provide a pair of opposed dogs which engage the opposite ends of the log to clamp the log between such carriage units and carry the clamped log through the primary breakdown log cutting means when driven by their common drive means. The distance between the front and rear carriage units must be adjusted to accommodate logs of different length, and this has been accomplished through the use of a cylinder means as shown in the above patent application of Foster, a clamping cable per the above Cameron patent or a rack and pinion means as shown in the above Jones patent. This use of a common drive for both carriage units involves a cumbersome and heavy carriage structure requiring a large horsepower motor to drive the carriage, which is slow and expensive. In addition, it has been previously proposed in U.S. Pat. No. 3,503,428 of Ackerfeldt, issued Mar. 31, 1970, to provide a plurality of end dogging carriages for the same primary breakdown system in a sawmill which are all driven by a common drive means, requiring a heavy drive chain and a large motor that is even more expensive.

The end dogging sawmill carriage of the present invention differs from such prior end dogging carriages by employing two independent drive means for the front and rear carriage units so that they can be quickly and easily operated in different directions to change the distance between the end dogs for clamping logs of different length between the front and rear carriage units. Also, the two drive means can be temporarily connected together to share the load when driving the log through the cutting means. This allows the carriage units to be made of smaller size and lighter in weight so that the drive motors used for their independent drive means can be of smaller horsepower.

It has been proposed to operate two independent drives connected to the front and rear carriage units of an end dogging sawmill carriage in such a manner that the front carriage unit resists forward movement and exerts a pressure on the log in a rearward direction to maintain the log clamped between the front and rear carriage units. For example, see U.S. Pat. No. 4,338,986 of Detjen, issued July 13, 1982, assigned to McDonough Manufacturing Company and the other Detjen patents cited therein. However, when the clamped log is moved forward in such a carriage, the drive means of the front carriage unit is not helping the drive means of the rear carriage unit drive the log forward but actually is hindering such forward drive by pushing the log rearward to maintain clamping. As a result, the rear carriage unit drive motor must be of even larger horsepower than a common drive means, since it must not only do all the work to drive the carriage forward to move the log through the cutting means, but must also overcome the rearward pressure of the front carriage unit drive motor. In addition, in some cases in order to maintain proper clamping pressure during movement of the log, the two independent drives must be synchronized to maintain the carriage units at the proper relative position and speed, which requires a complex electronic control system. Furthermore, if there is a power failure to the drives or the drives lose synchronism, the proper clamping of the log may be prevented so that the log is dropped from the carriage, resulting damage to machinery and a serious safety problem for operators within the mill.

The above-identified problems have been overcome by the present invention, which includes a releasable connection means for mechanically connecting the pair of independent drive means together temporarily while the log is clamped between the dogs of the front and rear carriage units, and for maintaining the log clamped while the log is driven forward toward the primary breakdown cutting means by both of such pair of drive means. Thus, by such releasable connection means, it is no longer necessary for the front carriage drive means to drive the front carriage unit rearwardly, thereby opposing the forward drive of the rear carriage unit. Instead both the front and rear carriage unit drives share the load and drive the log forward through the cutting means, thereby reducing the required size of the drive motors. In addition, there is no danger in the log falling from the carriage due to power failure or lack of synchronism, since the log clamping is maintained by the mechanical connection of the releasable connection means.

The sawmill carriage of the present invention in one embodiment temporarily connects the rear carriage unit to the drive cable of the front carriage unit by means of a cylinder actuated cable clamp or other automatically actuated mechanical connector so that the spacing between the carriage units can be adjusted to different log lengths and then fixed. Once the cable clamp is actuated, the carriage drives for the carriage units can both be used to drive the carriage forward to move the log through the primary breakdown cutting means. This results in several advantages, including a reduction in the size of the carriage drive motors because the two drive motors share the load evenly, both driving the log through the cutting means. Thus, the front carriage unit no longer needs to be driven rearwardly by its drive unit to maintain the log clamped between such carriage units. In addition, as discussed above, the log clamp pressure will not be lost in the event of a drive failure, which prevents accidental dropping of the log, thereby making the sawmill carriage safer. Furthermore, the carriage units and their drive systems can be of smaller size and of lighter weight construction, thereby improving the response time of the carriage and reducing the cost of the carriage. Another advantage is that since the front and rear carriage units are operated by independent drive means, they can be more quickly and easily adjusted to change the distance between the carriage units to accommodate a wide range of log lengths.

SUMMARY OF INVENTION

It is therefore one object of the present invention to provide an improved end dogging sawmill carriage, including front and carriage units, each having an independent drive, and a releasable connection for mechanically connecting the drives together temporarily while the log is clamped between the carriage units and for maintaining such clamping as the log is being driven by both of such drives toward the primary breakdown cutting means.

Another object of the invention is to provide such a sawmill carriage which shares the load during cutting between two independent drives for the front and rear carriage units and thereby reduces the sizes of the drives, including the drive motors.

A further object of the invention is to provide such an improved sawmill carriage in which such releasable connection prevents the loss of log clamp pressure and the dropping of logs in the event of drive failure, thereby providing a safer operation for such carriage.

An additional object of the invention is to provide such a sawmill carriage of faster response and reduced cost, due to the fact that the releasable connection is automatically actuated and the carriage units are smaller and of lighter weight.

A still additional object of the invention is to provide such an improved sawmill carriage in which the spacing between the front and rear carriage units can be adjusted quickly and easily by the independent drive means in order to accommodate a wide range of log lengths.

Still another object of the invention is to provide such an improved sawmill carriage in which the pair of independent drive means for driving the front and rear carriage units are releasably connected together by an automatically actuated mechanical connection in a simple and trouble-free manner.

A still further object of the present invention is to provide such a sawmill carriage in which the releasable connection is accomplished by means of a clamp or other mechanical connector mounted on one carriage unit for engagement with the drive cable or other drive coupling means of the other carriage unit while a log is clamped between such carriage units.

DESCRIPTION OF DRAWINGS

Other objects and advantages of the present invention will be apparent from the following detailed description of preferred embodiments thereof and from the attached drawings of which.

DESCRIPTION OF PREFERRED EMBODIMENTS

Figures 1, 2, 7, 8:
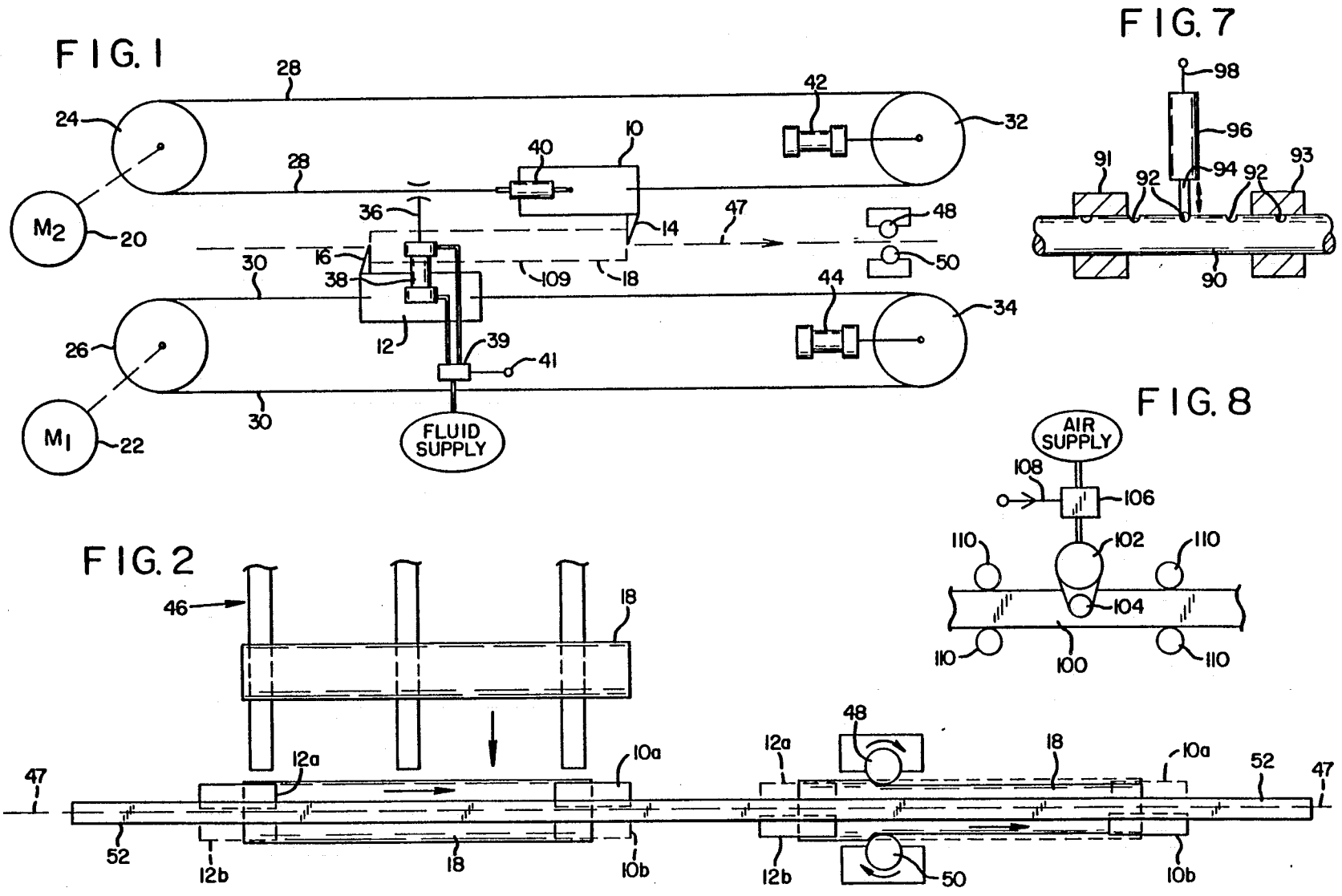
FIG. 1 is a diagrammatic view showing one embodiment of the end dogging sawmill carriage of the invention.
FIG. 2 is a plan view of a dual carriage system using the sawmill carriage of FIG. 1.
FIG. 7 is a diagrammatic view showing a second embodiment of the releasable connector which may be used in place of the cable clamp of FIG. 1.
FIG. 8 is a diagrammatic view showing a third embodiment of the releasable connector which may be substituted for the cable clamp.

As shown in FIG. 1, one embodiment of the end dogging sawmill carriage system of the present invention includes a front carriage unit 10 and a rear carriage unit 12, each of which includes a retractable dog 14 and 16 for engagement with the opposite ends of a log 18. Each of the carriage units 10 and 12 is attached to a different independent drive means, including a power source such as a first drive motor 20 and a second drive motor 22, which may be DC electric drive motors of the type used on winches. The drive motors 20 and 22 are connected to the shafts of drive pulleys 24 and 26, respectively, for driving flexible coupling means such as first and second cables 28 and 30 connected, respectively, to the front carriage unit 10 and the rear carriage unit 12. The first drive cable 28 has one end extending from the drive pulley 24 to the left side of the front carriage unit 10 and has its other end connected to the right side of such front carriage unit after passing around an idler pulley 32. In a similar manner, the second drive cable 30 is attached at one end to the left side of the rear carriage unit 12 while the other end of such cable extends around a second idler pulley 34 and is fixed to the right side of such rear carriage unit. The carriage units 10 and 12 roll along guide tracks (not shown) in a manner hereafter described, and the dogs 14 and 16 may be retracted or moved into the extended position shown in FIG. 1 by means of dog cylinders (not shown) mounted on the carriage units in a manner hereafter described.

When it is desired to clamp the log 18 between the front and rear carriage units, such carriage units are driven toward each other by their independent drive motors 20 and 22 until the dogs 14 and 16 engage the opposite ends of the log. While in this clamped position, a releasable connection means such as a mechanical cable clamp 36 is automatically actuated by a fluid cylinder 38, both mounted on one of the carriage units, in response to the operation of a solenoid valve 39 by an electrical control signal on signal input 41 to clamp the drive cable of the other carriage unit. Thus, in the example shown in FIG. 1, the mechanical clamp 36, 38 is fixedly mounted on the rear carriage 12 and when actuated the clamp is positioned to engage the drive cable 28 of the front carriage 10, thereby fixing the space between the front and rear carriage to correspond to the length of the log 18 being clamped. Log clamping pressure is maintained by a double acting log clamping cylinder 40 fixedly mounted on the front carriage unit 10 and having the opposite ends of its piston attached between the ends of the first cable 28 to rearwardly bias the front carriage unit. In addition, there is a cable tensioning cylinder 42 and 44 connected to each of the idler pulleys 32 and 34 for changing the cable tension in order to enable changing of the drive cable and maintain it in proper tension during operation.

Figure 3:
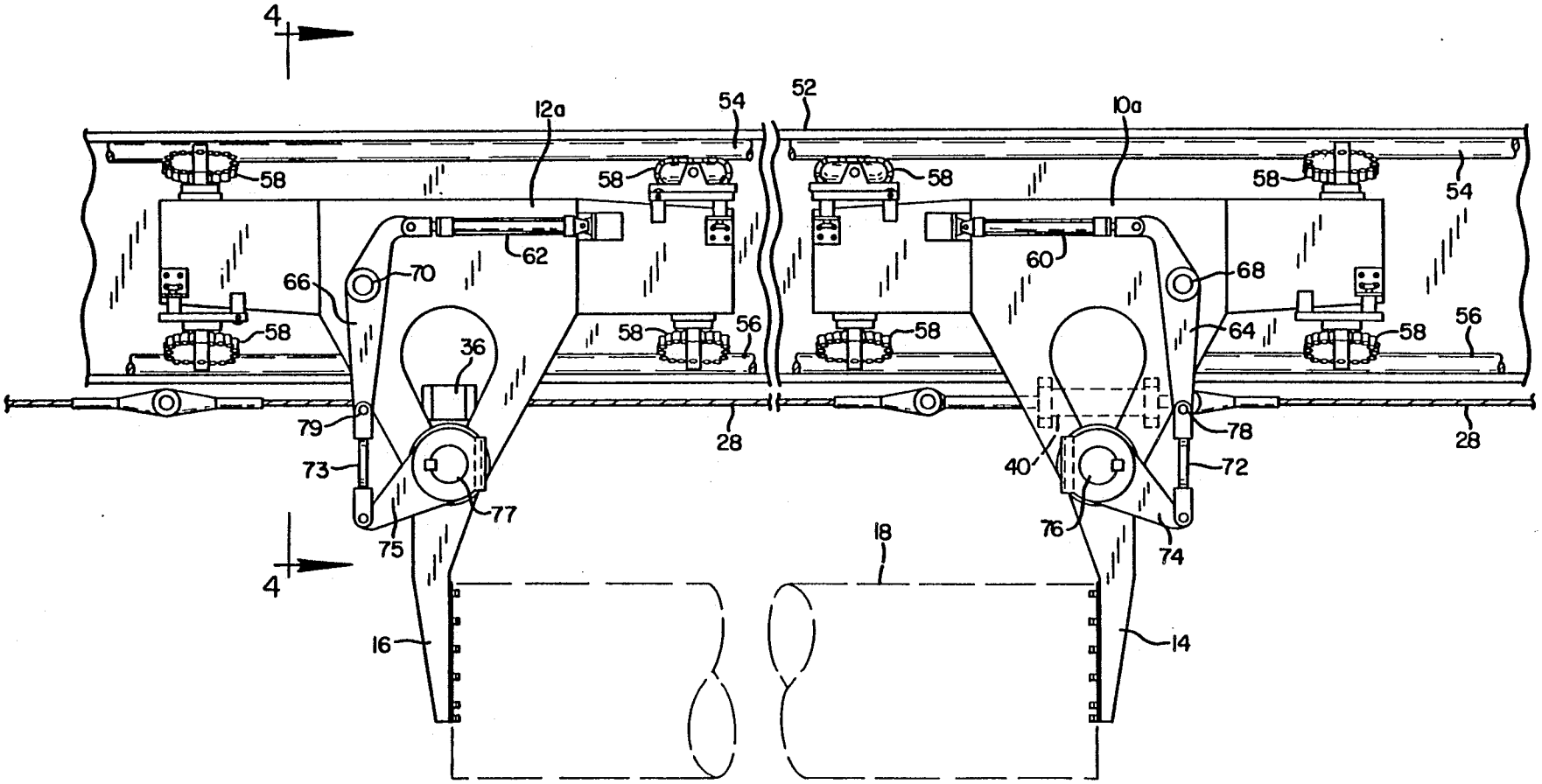
FIG. 3 is an enlarged side elevation view of a portion of the carriage of FIG. 2.
Figure 4:
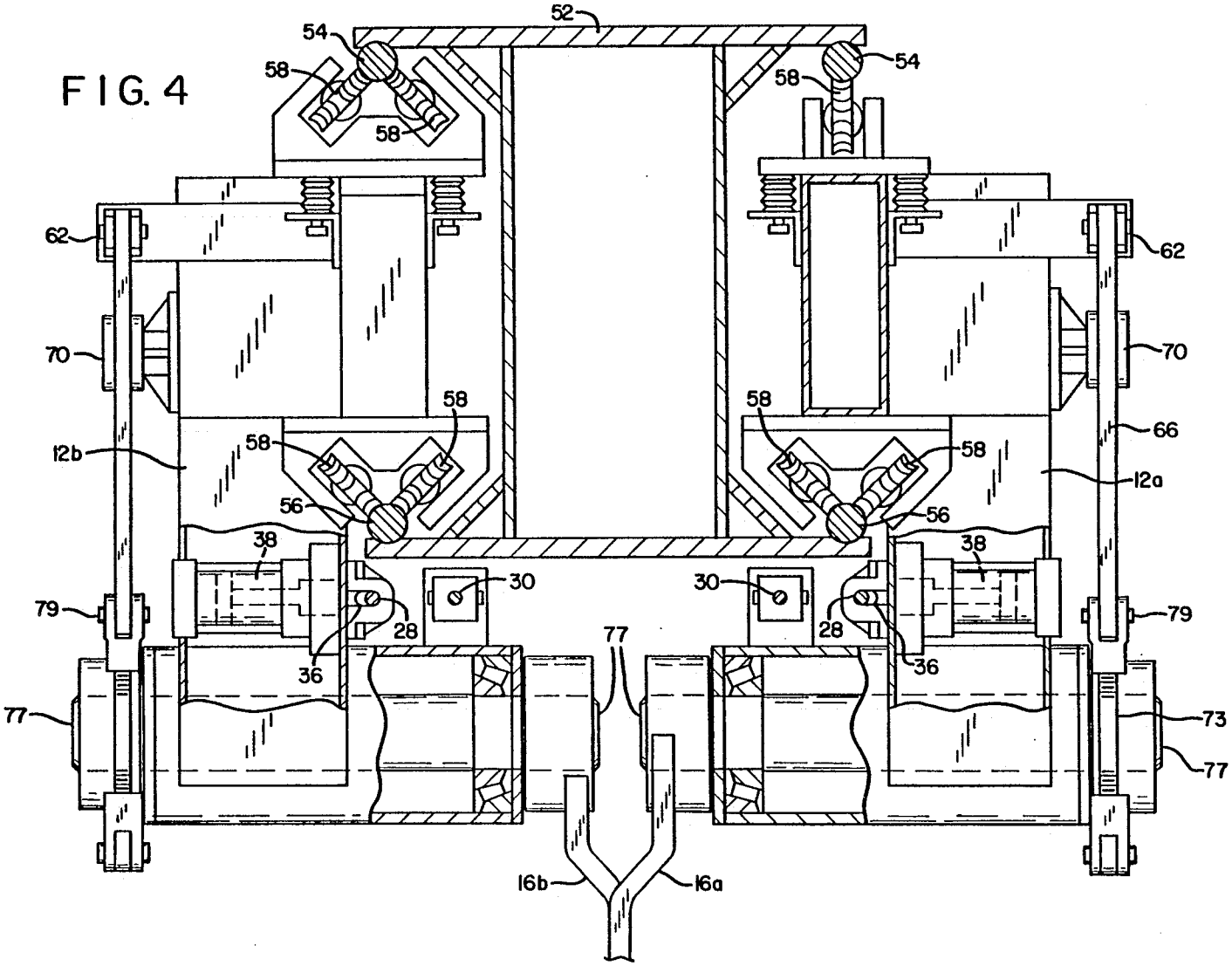
FIG. 4 is an enlarged vertical section view taken along the line 4—4 of FIG. 3, with the second carriage **10*b*, 12*b* in the dashed line portion of FIG. 2** so the two carriages are in alignment.

As shown in FIGS. 2, 3 and 4, the preferred embodiment of the end dogging sawmill carriage of FIG. 1 may include a log charger 46, including three adjustable charger arms for loading logs 18 into the carriage after such logs have been scanned in the charger with light scanners (not shown) to determine the optimum yield axis of the log and repositioned to align such axis with the index line 47 of the primary breakdown cutting system when the logs are transferred to the carriage. Two end dogging carriages 1O*a*, 12*a* and 10*b*, 12*b*, may be provided which operate in an alternating manner to feed the logs rapidly through the primary breakdown cutting system of the sawmill. The primary breakdown cutting system may include two rotating chipper heads 48 and 50 on opposite sides of the log as well as a third chipper head (not shown) in FIG. 2 for cutting the sides and bottom of the log to provide flat reference surfaces before the logs are fed through saws such as bandmill saws or gang saws in order to saw the log into boards or other lumber in a conventional manner. As shown in FIG. 2, each of the end dogging sawmill carriages 10*a*, 12*a* and 10*b*, 12*b*, is mounted on a guide track supported on an I-beam 52 in a manner shown in FIGS. 3 and 4.

As shown in FIGS. 3 and 4, the I-beam 52 has two pairs of track rods 54 and 56 of circular cross-section welded to the top and bottom flanges of the I-beam and extending along the length of the I-beam to provide a pair of guide tracks 54, 56 for each of the two sawmill carriages 10*a*, 12*a* and 10*b*, 12*b*. The front carriage unit 10 and the rear carriage unit 12 are each provided with roller bearing track follower devices 58 that engage the track rods 54 and 56 to maintain the carriage units on the track and to allow sliding movement of such units along a track with a minimum of friction.

The front dog 14 and the rear dog 16 are each provided with a dog actuating cylinder 60 and 62, respectively, as shown in FIG. 3. The cylinders 60 and 62 have their piston rods pivotally connected to one end of a lever arm 64, 66, respectively, which rotates about a fixed pivot 68, 70 on the carriage unit. The lever arms 64 and 66 are connected by links 72, 73 to an actuator arm 74, 75 which rotates an actuation shaft 76, 77 for the dogs 14 and 16. As a result, actuation of the dog cylinder 60 to extend its piston rod causes lever arm 64 to rotate clockwise about pivot 68 which, in turn, causes the actuation arm 74 and the shaft 76 to rotate counterclockwise, thereby raising the front dog 14 in a counterclockwise direction. Similarly, actuation of dog cylinder 62 to extend its piston rod causes the lever arm 66 to rotate in a counterclockwise direction which, in turn, causes the actuation arm 75 and shaft 77 to rotate in a clockwise direction, thereby raising the rear dog 16 in a clockwise direction about shaft 77. It should be noted that the lever arms 64 and 66 are connected by a moving pivot 78, 79 to the links 72, 73, which allows counter rotation of the actuation arms 74 and 75 in the opposite direction to rotation of the lever arms 64 and 66.

Each of the dog actuating cylinder 60 and 62 and the rest of its associated dog mechanism is mounted on one of the carriage units 10*a* and 12*a* for movement therewith along the track. Thus, the carriage units are moved toward each other to clamp the log between the front dog 14 and the rear dog 16 and are temporarily connected together by means of the cable clamp 36 upon actuation of the cable clamp cylinder 38 shown in FIG. 4 in the manner previously described with respect to FIG. 1. The independent drives 20, 28 and 22, 30 move the carriage units apart and together in order to enable adjustment of the spacing between the front dog 14 and the rear dog 16 to accommodate logs 18 of different length. Once the cable clamp is actuated to fix the spacing between the front and rear dogs, the clamping pressure cylinder 40 is actuated in order to pull the front dog 14 rearwardly and thereby maintain proper clamping pressure on the log. Then both of the independent drives 20, 28 and 22, 30 can share the load and move the log through the log cutting means 48, 50.

Figure 6:
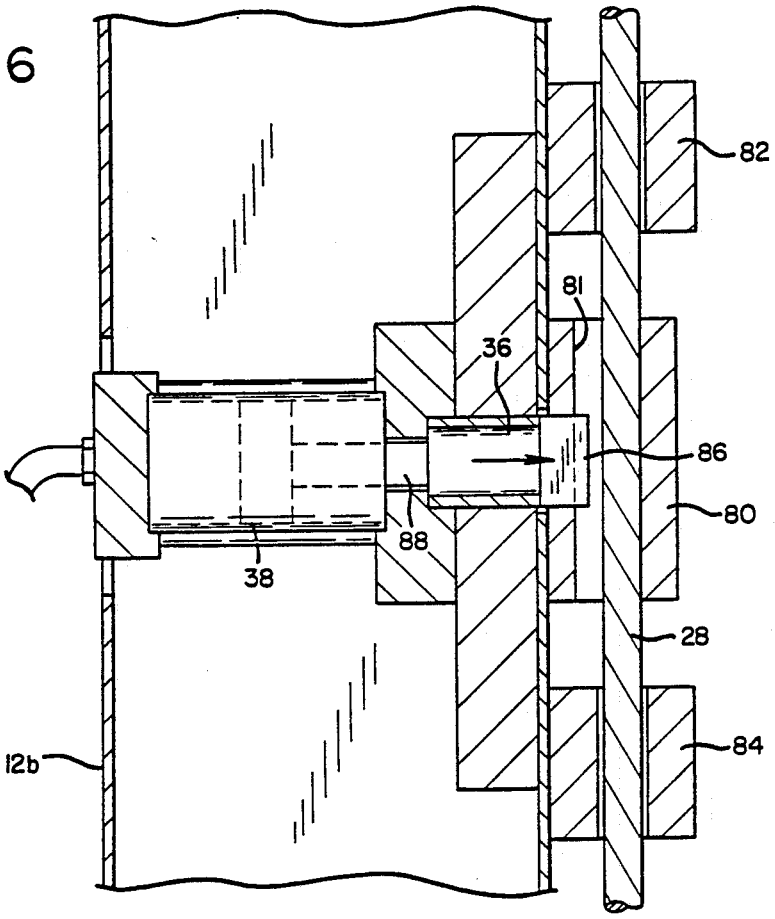
FIG. 6 is a horizontal section view taken along the line 6—6 of FIG. 5.
Figure 5:
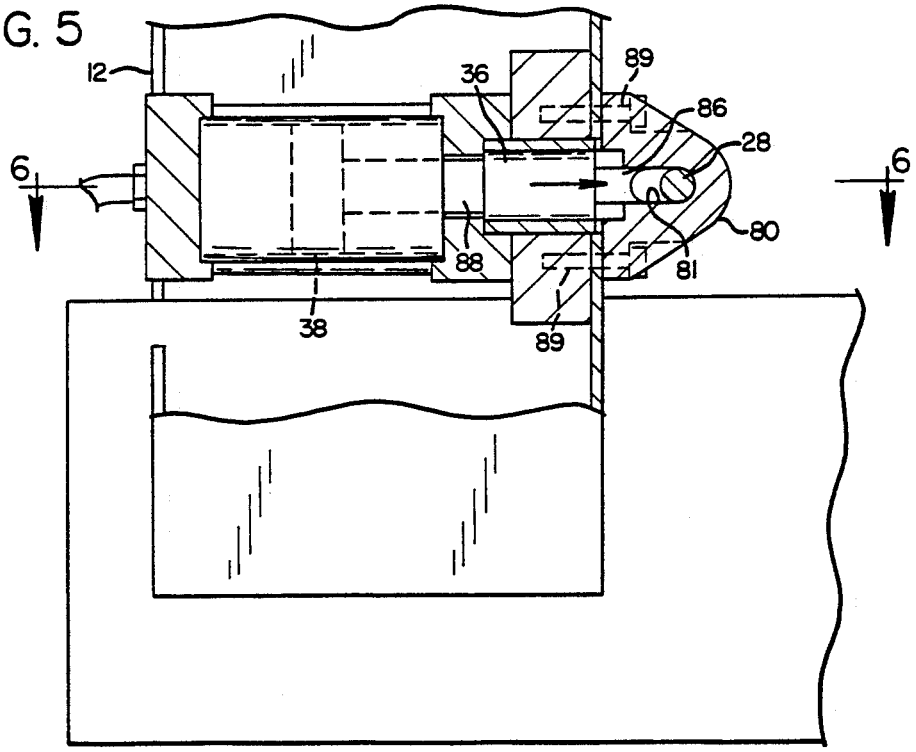
FIG. 5 is an enlarged view of a portion of FIG. 4 showing the cable clamp.

The cable clamp mechanism 36 is shown in greater detail in FIGS. 5 and 6 and includes a fixed clamp member 80 having an elongated slot 81 through which the first cable 28 of the front carriage unit extends, such cable being guided for sliding movement by a pair of cable guides 82 and 84 on opposite sides of such clamp. A movable clamp member 86 is secured to the top of a piston rod 88 connected to the piston within the clamp actuation cylinder 38. Thus, upon operation of cylinder 38 by the solenoid valve 39, the piston rod 88 and the movable clamp member 86 both move upward until the clamp member engages the cable 28 and clamps it between the movable clamp member 86 and the fixed clamp member 80. The cable clamp 36 is fixed to the frame of the rear carriage unit 2 by bolts 89 or other suitable means. When the cable clamp is actuated, the rear carriage unit then is temporarily connected to the first drive cable 28 which is fixed to the front carriage unit so that both carriage units move together, spaced apart a selected distance between such carriage units corresponding to the length of the log 18. This allows the drive motors of both the front and rear carriage to share the load of the log 18 as such log is moved forward through the primary breakdown cutting means as discussed above. In addition, this cable clamp prevents the log from being dropped by the end dogging carriage in the event of power failure of either of the two drive motors.

FIGS. 7 and 8 show two other ways of temporarily connecting the rear carriage unit 12 to the drive means of the front carriage unit 10 rather than using a cable clamp for the purpose described. Thus, a second embodiment of a releasable connection means is shown in FIG. 7, in which the cable section at the end of the first drive cable 28 which is engaged by the cable clamp 36 in the embodiment of FIG. 1, is replaced by a notched metal rod 90 which may be of circular cross-section connected at one end to the first drive cable 28 and at its other end to the front carriage 10 and mounted to slide through guide bearings 91 and 93. A plurality of longitudinally spaced adjustment notches 92 are provided in one side of the connecting rod 90 for engagement with a latch member 94 of a solenoid actuated lock 96. The latter member is moved into and out of the selected notch 92 by means of a solenoid in response to an electrical control signal applied to input terminal 98 of such solenoid lock. The solenoid actuated lock 96 is mounted on the rear carriage unit 12 and when its latch member 94 is extended into one of the notches 92 on the connecting shaft 90, the rear carriage unit and the front carriage unit 10 are temporarily connected together. In this manner, the spacing between such carriage units can be selected to accommodate logs of different length and adjusted in increments depending upon the notch spacing. Because of this incremental spacing adjustment, a clamping pressure cylinder similar to cylinder 40 of FIG. 1 may be used to maintain clamping pressure.

A third embodiment of a releasable connecting means used in the present invention is shown in FIG. 8 and includes a metal connector bar 100 similar to connector bar 90 of FIG. 7 but flat and without the notches. One end of such connector bar is attached to the front carriage 10 and the other end is fixed to the drive cable 28. An air caliber brake 102 is mounted on the rear carriage and is provided with a pair of brake shoes 104 which engage the opposite sides of the connector bar 100 when the brake is actuated. The brake may include a brake cylinder (not shown) like disc brakes for automobiles, which is actuated by fluid pressure such as air pressure through a solenoid valve 106 in response to an input signal at input terminal 108. It should be noted that a pair of support rollers 110 may be provided for the connector bar 100 on opposite sides of the brake 102 in order to support and guide movement of such connector bar along a predetermined path to prevent misalignment. This embodiment has the advantage over that of FIG. 7 in that the spacing between the front and rear carriages may be adjusted continuously rather than in increments to accommodate different log lengths.

It will be obvious to those having ordinary skill in the art that many changes may be made in the above described embodiments of the invention without parting from the spirit of the invention. Therefore, the scope of the present invention should be determined by the following claims.

I claim:

1. Sawmill carriage apparatus comprising:

a pair of end dogging carriage units, including a front carriage unit and a rear carriage unit, each including an adjustable dog means for engaging one end of a log to clamp the log between the front carriage unit and the rear carriage unit;

a pair of carriage drive means for driving said front carriage unit and rear carriage unit independently to position the carriage units relative to the log to enable clamping of the log, and for driving the carriage units together by both drive means when the carriage units are interconnected to move the log through a log cutting means; and releasable connection means for mechanically connecting said pair of drive means together temporarily while the log is clamped and for maintaining said log clamped between said front and rear carriage units while the log is being driven forward toward said cutting means by said pair of drive means.

2. Apparatus in accordance with claim 1 in which the pair of drive means each include a drive motor and a coupling means for coupling said drive motor to one of said pair of carriage units.

3. Apparatus in accordance with claim 2 in which the connection means automatically connects the coupling means of the one carriage unit to the other carriage unit in response to a control signal applied to said connection means.

4. Apparatus in accordance with claim 2 in which the coupling means is a cable which is fixed to its associated carriage unit.

5. Apparatus in accordance with claim 4 in which the connection means is a releasable clamp means for engaging the cable.

6. Apparatus in accordance with claim 5 in which the clamp means includes an automatic control means for actuation of said clamp means in response to a control signal.

7. Apparatus in accordance with claim 6 in which the clamp means includes a fluid cylinder and the control means includes an electrically actuated valve means connected to said cylinder.

8. Apparatus in accordance with claim 1 which is a dual carriage apparatus, including two end dogging carriages, each having a pair of carriage units and associated pair of independent drive means and releasable connection means.

9. Apparatus in accordance with claim 5 in which the coupling means is a cable and the clamp means is mounted on one carriage unit for clamping the cable which drives the other carriage unit of said pair of carriage units.

10. Sawmill carriage apparatus comprising:

a pair of end dogging carriage units, including a front carriage unit and a rear carriage unit, each including an adjustable dog means for engaging one end of a log to clamp the log between the front carriage unit and the rear carriage unit;

a pair of carriage drive means for driving said front carriage unit and rear carriage unit independently to position the carriage units relative to the log and for driving the carriage units together by both drive means when the carriage units are interconnected to move the log through a log cutting means, said pair of drive means each including a drive motor and a coupling means for coupling said drive motor to one of said carriage units; and automatic connection means for mechanically connecting said pair of drive means together temporarily while the log is clamped and for maintaining said log clamped between said front and rear carriage units while the log is being driven forward toward said cutting means by said pair of drive means.

11. Apparatus in accordance with claim 10 in which the coupling means includes a cable.

12. Apparatus in accordance with claim 10 in which the connection means releasably connects the coupling means of the one carriage unit to the other carriage unit in response to a control signal applied to said connection means.

13. Apparatus in accordance with claim 12 in which the coupling means is a flexible coupling which is fixed to its associated carriage unit.

14. Apparatus in accordance with claim 11 in which the connection means is a releasable clamp means on one carriage unit for engaging the cable of the other carriage unit.

15. Apparatus in accordance with claim 14 in which the clamp means includes an automatic control means for actuation of said clamp means in response to a control signal.

16. Apparatus in accordance with claim 15 in which the clamp means includes a fluid cylinder actuator and the control means includes an electrically actuated valve means connected to said cylinder.

17. Apparatus in accordance with claim 12 in which the connection means is a solenoid actuated lock.

18. Apparatus in accordance with claim 17 in which the solenoid actuated lock is fixed to one carriage unit and selectively engages one notch of a plurality of notches on a notched shaft serving as part of said coupling means of the other carriage unit.

19. Apparatus in accordance with claim 12 in which the connection means is a fluid actuated brake.

20. Apparatus in accordance with claim 19 in which the brake is on one carriage unit and clamps a rigid bar which serves as part of the coupling means of the other carriage unit.

* * * * *

UNITED STATES PATENT AND TRADEMARK OFFICE

CERTIFICATE OF CORRECTION

PATENT NO. : 4,996,900

DATED : March 5, 1991

INVENTOR(S) : Hugh E. Schmidt et al.

It is certified that error appears in the above-identified patent and that said Letters Patent is hereby corrected as shown below:

Column 6, line 32, "2" should be --12--;

Column 7, lines 46-57, "for driving the carriage units together" should be --for driving the front and rear carriage units together--.

Signed and Sealed this

Fourth Day of August, 1992

*Attest:*

DOUGLAS B. COMER

*Attesting Officer*

*Acting Commissioner of Patents and Trademarks*